US008203521B2

(12) United States Patent
Lin et al.

(10) Patent No.: US 8,203,521 B2
(45) Date of Patent: Jun. 19, 2012

(54) METHOD OF GENERATING FRAME CONTROL SIGNAL FOR REDUCING REACTION TIME

(75) Inventors: Fang-Cheng Lin, Wurih Township, Taichung County (TW); Yi-Pai Huang, Chiayi (TW); Ching-Ming Wei, Taichung (TW); Han-Ping D. Shieh, Hsinchu (TW)

(73) Assignee: National Chiao Tung University, Hsinchu (TW)

( * ) Notice: Subject to any disclaimer, the term of this patent is extended or adjusted under 35 U.S.C. 154(b) by 1083 days.

(21) Appl. No.: 12/007,323

(22) Filed: Jan. 9, 2008

(65) Prior Publication Data

US 2009/0146990 A1 Jun. 11, 2009

(30) Foreign Application Priority Data

Dec. 10, 2007 (TW) ..... 96146958 A

(51) Int. Cl.
*G09G 3/36* (2006.01)

(52) U.S. Cl. ..... 345/102; 345/87

(58) Field of Classification Search ..... 345/87–104, 345/214

See application file for complete search history.

(56) References Cited

U.S. PATENT DOCUMENTS

| | | | | |
|---|---|---|---|---|
| 5,337,068 | A | 8/1994 | Stewart et al. | |
| 5,717,422 | A | 2/1998 | Fergason | |
| 6,891,672 | B2 | 5/2005 | Whitehead et al. | |
| 6,981,672 | B2 | 1/2006 | Clancy et al. | |
| 7,057,668 | B2 | 6/2006 | Herrmann | |
| 2005/0078081 | A1 * | 4/2005 | Oda et al. | 345/102 |
| 2005/0122287 | A1 * | 6/2005 | Nishitani et al. | 345/63 |
| 2005/0146492 | A1 * | 7/2005 | Baba et al. | 345/87 |
| 2005/0231457 | A1 * | 10/2005 | Yamamoto et al. | 345/102 |
| 2006/0125771 | A1 * | 6/2006 | Inuzuka et al. | 345/102 |
| 2007/0109254 | A1 * | 5/2007 | Kang | 345/103 |
| 2007/0279374 | A1 * | 12/2007 | Kimura et al. | 345/102 |
| 2008/0007512 | A1 * | 1/2008 | Honbo | 345/102 |
| 2008/0036729 | A1 * | 2/2008 | Mukuda | 345/102 |
| 2008/0224987 | A1 * | 9/2008 | Eckhardt | 345/102 |
| 2009/0115718 | A1 * | 5/2009 | Qiao et al. | 345/102 |
| 2009/0128583 | A1 * | 5/2009 | Choi | 345/690 |
| 2009/0141178 | A1 * | 6/2009 | Kerofsky et al. | 348/700 |

OTHER PUBLICATIONS

Jongseo Lee et al., "Noble Measurement Method for Color Breakup Artifact in FPDs", IMID/IDMC'06 Digest, pp. 92-97.

Kazuo Sekiya, "Late-News Paper: A Simple and Practical Way to Cope with Color Breakup on Field Sequential Color LCDs" SID 06 Digest, pp. 1661-1664.

(Continued)

*Primary Examiner* — Alexander Eisen
*Assistant Examiner* — Nelson Lam
(74) *Attorney, Agent, or Firm* — Stites & Harbison, PLLC; Juan Carlo A. Marquez, Esq.

(57) ABSTRACT

A method of generating frame control signals for reducing reaction time comprises following steps: analyzing an input frame signal; generating a first reference liquid crystal control signal of a frame; setting a second liquid crystal control signal range and thereby generating a second reference liquid crystal control signal; generating a second backlight control signal according to the first reference liquid crystal control signal and the second reference liquid crystal control signal; and generating a second liquid crystal control signal of each pixel according to the second backlight control signal. By confining the second backlight control signal to the second liquid crystal control signal range, the reaction time of the liquid crystals is reduced and the frame quality of LCD devices is enhanced.

8 Claims, 5 Drawing Sheets

OTHER PUBLICATIONS

Wei-Chung Cheng et al., "Perception-Guided Power Minimization for Color Sequential Displays", National Chiao Tung University, pp. 290-295, ACM 2006.

J. H. Stessen et al., "Algorithm for Contrast Reserve, Backlight Dimming, and Backlight Boosting on LCD", SID 06 Digest, pp. 1249-1252.

* cited by examiner

METHOD OF GENERATING FRAME CONTROL SIGNAL FOR REDUCING REACTION TIME

BACKGROUND OF THE INVENTION

1. Technical Field

The present invention relates to a method of generating frame control signals for reducing reaction time and, more particularly, to a method of generating frame control signals while reducing reaction time of liquid crystals.

2. Description of Related Art

Recently, with the progress of display industry, in addition to the gradual advancement and maturity of hardware processes for display devices, the display technologies applied to display devices have also developed continuously. For example, the technologies of field sequential color (FSC) and high dynamic range (HDR) have been introduced in the attempt to improve the displayed frame quality of display devices.

The FSC technology works by separately displaying a red sub-frame, a green sub-frame and a blue sub-frame, which are later integrated in a viewer's visual system. The FSC technology achieves chromatic display without a need of color filters so as to enhance light efficiency and save the costs for color filters, resulting in reduced manufacturing costs for an overall LCD device.

However, a display frequency of such chromatic frame is 60 Hz, meaning that only if 60 chromatic frames are displayed in each second, the chromatic frame is successfully displayed. Also, each of the chromatic frames is formed by sequentially displaying a red sub-frame, a green sub-frame and a blue sub-frame. This is to say, each said chromatic frame has to be displayed in 16.7 milliseconds and there is only a period of 5.6 milliseconds for displaying each said sub-frame. Yet, the work of controlling the liquid crystal rotation and changing the liquid crystal transmission can consume 2 to 3 milliseconds or more therein. Hence, a need exits for improving LCD display technologies by reducing the reaction time of liquid crystals.

Besides, according to the principle of the FSC technology, in order to reproduce the color information of all the pixels in a chromatic frame through the human visual system, the color fields of the three primary colors contained in the color information must be projected to a very point in the viewer's retina. If the color fields are otherwise projected to different points in the retina, the viewer's visual system can detect such deviation and makes the viewer catch an image with separated and deviated color fields, namely a CBU (color break-up) image. As color break-up can significantly debase display quality, it is a serious problem to be solved in the FSC technology.

On the other hand, the HDR technology is based on adjusting the backlight brightness of each display region in the frame according to the distribution of brightness over the displayed image. For example, in a display region where a dark portion in the image is to be displayed, the backlight is lowered or even turned off so as to prevent light leakage caused by imperfect liquid crystal alignment or failure of two polarizers in fully blocking downward backlight at a large view-angle. Thereupon, the contrast of LCD devices can be enhanced and the power consumption of LCD devices can be reduced.

The control signals are typically loaded from the upper left corner toward the lower right corner of the LCD device and properly rotate liquid crystals to change the liquid crystal transmission. However, since the reaction time of the liquid crystals is quite long, it tends to happen that the upper left liquid crystals have been already rotated to proper positions while the lower right ones have not yet, resulting in blurred images and incorrect color display. Therefore, if the reaction time of liquid crystals can be reduced, the refresh frequency of liquid crystals can be increased and the effect of mitigating image blur can be in turn achieved.

SUMMARY OF THE INVENTION

The present invention provides a method of generating frame control signals for reducing reaction time. By confining a second liquid crystal control signal to a second liquid crystal control signal range, the second liquid crystal control signal can be retained in a region with a shorter reaction time. Also, by implementing a proper second backlight control signal to compensate lost backlight brightness, a reaction time of liquid crystals can be reduced while a desired frame quality is still ensured. As the reaction time of the liquid crystals is reduced, a display time of each frame can be compressed and in turn the frame refresh frequency can be enhanced, so that an effect of improving the frame quality can be accomplished.

To achieve the above objectives, the disclosed method of generating frame control signals for reducing reaction time comprises: analyzing an input frame signal to acquire a plurality of first liquid crystal control signals and a plurality of first backlight control signals of each color light; generating a first reference liquid crystal control signal of a frame; setting a second liquid crystal control signal range and thereby generating a second reference liquid crystal control signal; generating a second backlight control signal according to the first reference liquid crystal control signal and the second reference liquid crystal control signal; and generating a second liquid crystal control signal of each pixel according to the second backlight control signal.

By implementing the present invention, at least the following effects can be achieved:

1. By reducing the liquid crystal reaction time, the refresh frequency of the frame can be enhanced so as to mitigate image blur or CBU in color sequential displays.
2. By reducing the liquid crystal reaction time, the liquid crystals are ensured to be rotated to positions for a predetermined transmission.
3. Under the reduced liquid crystal reaction time, a backlight module can be on for a lengthened period so as to enhance the brightness.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENT

Figure 1:
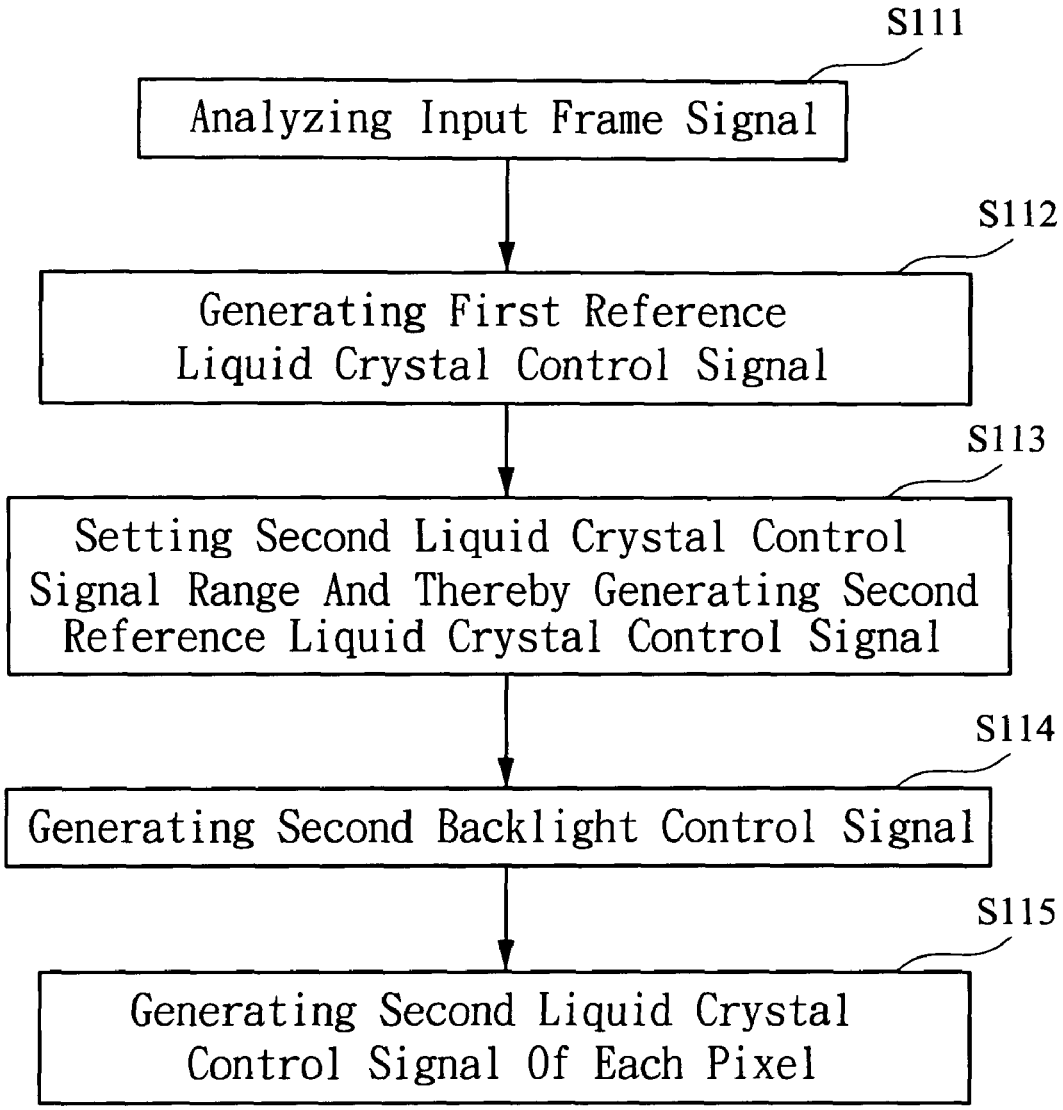
FIG. 1 is a flow chart for a method of generating frame control signals for reducing reaction time according to the present invention.

As shown in FIG. 1, the disclosed method of generating frame control signals for reducing reaction time comprises the following steps: analyzing an input frame signal S111; generating a first reference liquid crystal control signal S112; setting a second liquid crystal control signal range and thereby generating a second reference liquid crystal control signal S113; generating a second backlight control signal S114; and generating a second liquid crystal control signal of each pixel S115.

Figure 2:
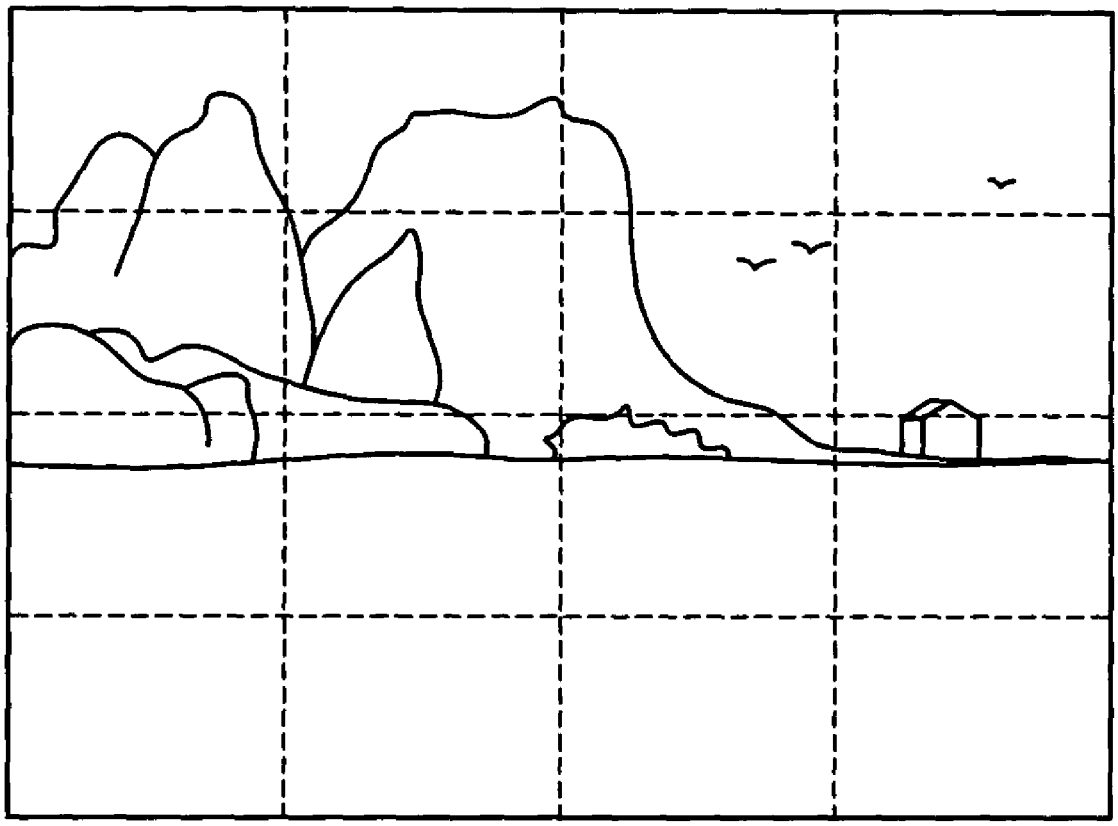
FIG. 2 is an embodiment of a chromatic frame to be displayed according to the present invention.

Analyzing an input frame signal S111: a chromatic frame to be displayed is as shown in FIG. 2 and is displayed by writing an input frame signal into a signal control module of an LCD device, wherein the input frame signal comprises a plurality of first backlight control signals 10 and a plurality of first liquid crystal control signals 11.

The first backlight control signals 10 are used to control a gray level value of a backlight brightness of each pixel in each color light so that the first backlight control signals 10 and the first liquid crystal control signals 11 of each pixel in each color light can be acquired by analyzing the input frame signal. Therein, the color lights may be combinations of a red light, a green light and a blue light.

For instance, if the backlight is in its full brightness, it means that the first backlight control signal 10 is the maximum value of the gray level value of the backlight brightness. That is to say, if an 8-bit control signal is implemented, the first backlight control signal 10 is 255. When the backlight is in its full brightness, it is possible to separately control a liquid crystal transmission in each pixel by controlling the driving voltage of a transistor of each pixel.

Figure 3:
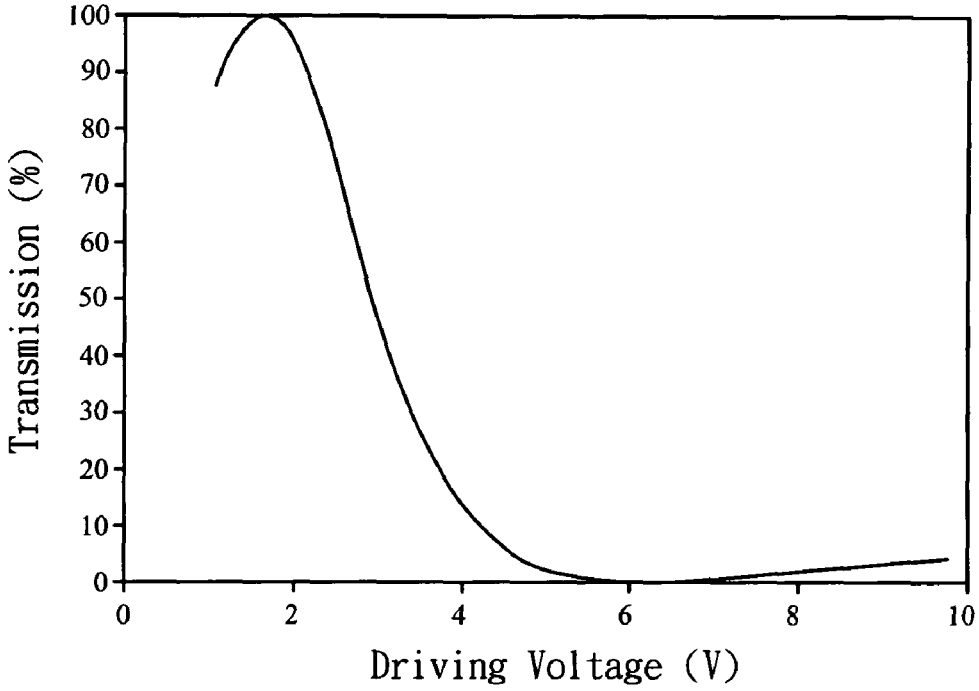
FIG. 3 is a graph showing the relation between a driving voltage and a liquid crystal transmission.

As shown in FIG. 3, when the driving voltage is 1.5V, the liquid crystal transmission is 100%. With the gradual increasing driving voltage, the liquid crystal transmission gradually descends accordingly. At the time the driving voltage is increased to 5~6V, the liquid crystal transmission is decreased to 0%. Thus, the liquid crystal transmission can be changed by controlling the driving voltage.

Figure 4:
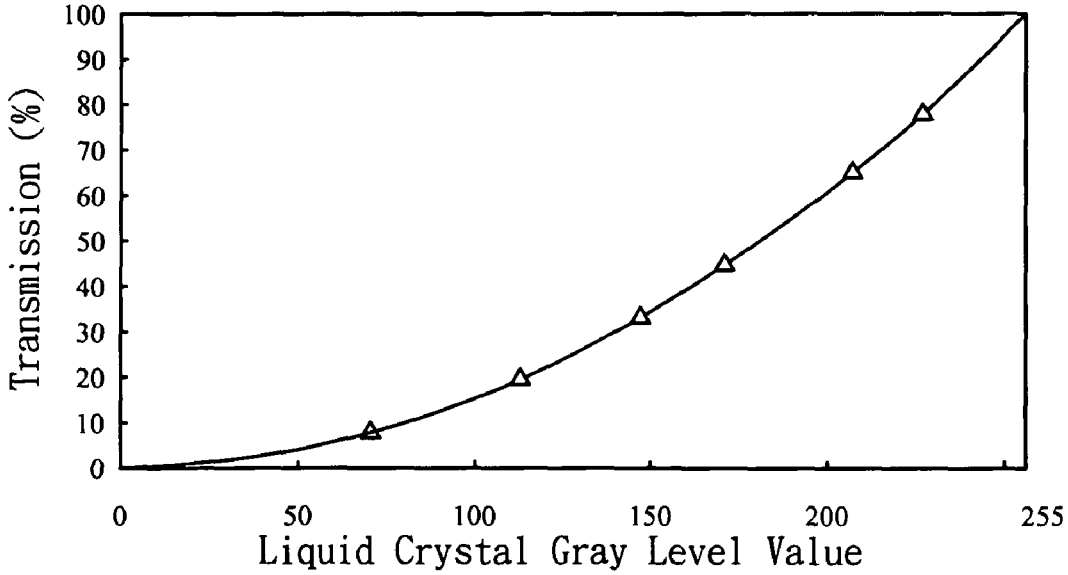
FIG. 4 is a graph showing the relation between a gray level value of liquid crystal and a liquid crystal transmission.

According to FIG. 4, different transmissions correspond to different liquid crystal gray level values so that the displayed color of each pixel can be changed by controlling the driving voltage of the transistor, allowing the overall displayed color to have brighter and darker portions. Thus, if the implemented control signal is an 8-bit control signal, the operational range of the first liquid crystal control signals 11 may range between 0 and 255.

Figure 5A:
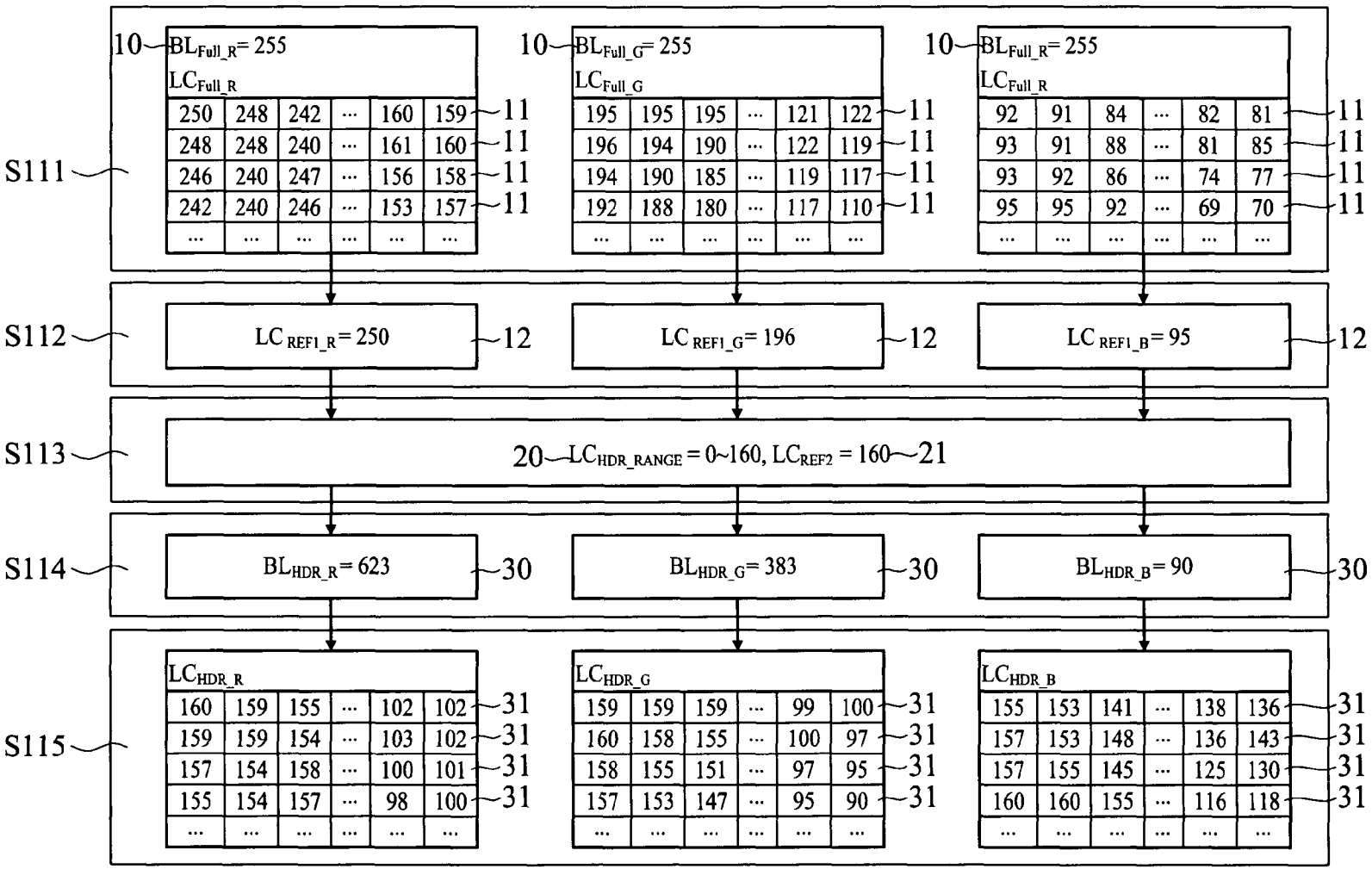
FIG. 5A provides one embodiment of the method of generating frame control signals for reducing reaction time according to the present invention.
Figure 5B:
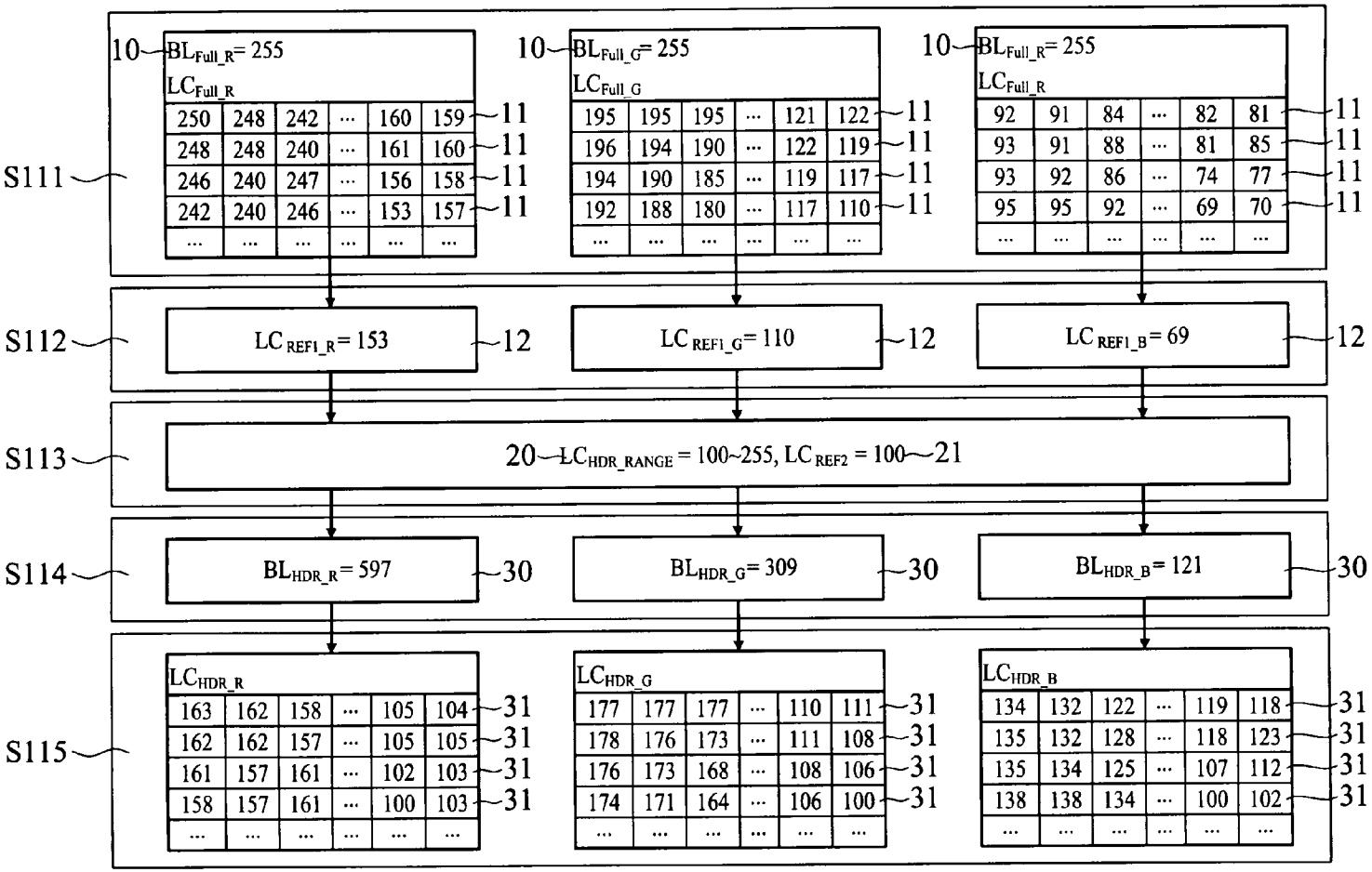
FIG. 5B provides another embodiment of the method of generating frame control signals for reducing reaction time according to the present invention.

As shown in FIGS. 5A and 5B, the first backlight control signals 10 and second backlight control signals 30 are the backlight control signals of the entire frame while the first liquid crystal control signals 11 and second liquid crystal control signals 31 are respectively a liquid crystal control signal of each pixel in the frame. The first backlight control signal 10 for each color light and the liquid crystal control signal 11 for each pixel can be derived from analyzing the input frame signal.

For example, when the first backlight control signal 10 of the red light is 255, the first liquid crystal control signals 11 of the red light are 250, 248, 246, 262, etc; when the first backlight control signal 10 of the green light is 255, the first liquid crystal control signals 11 of the green light are 195, 196, 194, 192, etc; and when the first backlight control signal 10 of the blue light is 255, the first liquid crystal control signals 11 of the blue light are 92, 93, 93, 95, etc.

Through FIGS. 3 and 4, since the operational range of the first liquid crystal control signals 11 ranges between 0 and 255, if the liquid crystal transmission is to be changed from 0% to 100%, or, in other words, the first liquid crystal control signals 11 are to be changed from 0 to 255, the driving voltage shall at least be decreased to 1.5V from 5.3V. However, at this time, the reaction time of the liquid crystal rotation is much more than the reaction time of the variation of the driving voltage from 3.5V to 1.5V. Thus, according to the present embodiment, the liquid crystals may be operated in the regions of shorter reaction time and then the required brightness of the frame can be compensated by modulating the backlight brightness.

Generating a first reference liquid crystal control signal S112: a maximum first liquid crystal control signal or a minimum first liquid crystal control signal may be generated by analyzing all the first liquid crystal control signals 11 of the frame and used as a first reference liquid crystal control signal 12. The maximum first liquid crystal control signal is the first liquid crystal control signal having the maximum value among all the first liquid crystal control signals 11 and the minimum first liquid crystal control signal is the first liquid crystal control signal having the minimum value among all the first liquid crystal control signals 11.

In FIG. 5A, if the first reference liquid crystal control signal 12 is the maximum first liquid crystal control signal, the first reference liquid crystal control signal 12 of the red light is 250; the first reference liquid crystal control signal 12 of the green light is 196; and the first reference liquid crystal control signal 12 of the blue light is 95. Alternatively, if the first reference liquid crystal control signal 12 is the minimum first liquid crystal control signal, as shown in FIG. 5B, the first reference liquid crystal control signal 12 of the red light is 153; the first reference liquid crystal control signal 12 of the green light is 110; and the first reference liquid crystal control signal 12 of the blue light is 69.

Setting a second liquid crystal control signal range and thereby generating a second reference liquid crystal control signal S113: if the second liquid crystal control signal 31 is an 8-bit control signal, the second liquid crystal control signal 31 can be operated within a range between 0 and 255. However, for reducing the liquid crystal reaction time so as to reduce the display of each frame and enhance the refresh frequency of the frame, in the present embodiment, the second liquid crystal control signal 31 is limited to be operated in a second liquid crystal control signal range 20. The second liquid crystal control signal range 20 is a small segment within the range between 0 and 255 that may be determined and changed according to the quality of the chromatic frame to be displayed.

For instance, as shown in FIGS. 5A and 5B, the second liquid crystal control signal range 20 may be set as a range between 0 and 160, or a range between 100 and 255. A second reference liquid crystal control signal 21 may be the maximum second liquid crystal control signal or the minimum second liquid crystal control signal. Since 0 and 255 are limits of the second liquid crystal control signal 31, when the second liquid crystal control signal range 20 is ranging from 0 to 160, the maximum second liquid crystal control signal, namely 160, is taken as the second reference liquid crystal control signal 21. Similarly, when the second liquid crystal control signal range 20 is ranging from 100 to 255, the minimum second liquid crystal control signal, namely 100, is taken as the second reference liquid crystal control signal 21.

Generating a second backlight control signal S114: the second liquid crystal control signal 31 is limited to be operated in the second liquid crystal control signal range 20 so as to reduce the reaction time of liquid crystals, and in turn to achieve the effect of compressing frame display time. However, since the liquid crystals are only operated in the range of the second liquid crystal control signals 31, the original backlight brightness tends to excessively dark or light and fails to achieve the frame quality of the chromatic frame generated by the originally input frame signals.

Thus, for matching the second liquid crystal control signal range 20, the second backlight control signal 30 may be generated according to the first reference liquid crystal control signal 12 and the second reference liquid crystal control signal 21. The second backlight control signal 30 can be derived from the following equation:

$$BL_{HDR}=(LC_{REF1}/LC_{REF2})^{r}*BL_{Full} \quad (1)$$

Therein, $BL_{HDR}$ is the second backlight control signal 30; $LC_{REF1}$ is the first reference liquid crystal control signal 12; $LC_{REF2}$ is the second reference liquid crystal control signal 21; r is a gamma factor; and $BL_{Full}$ is the first backlight control signal 10. Therein, the first reference liquid crystal control signal 12 is the maximum first liquid crystal control signal while the second reference liquid crystal control signal 21 is the maximum second liquid crystal control signal, or, alternatively, the first reference liquid crystal control signal 12 is the minimum first liquid crystal control signal while the second reference liquid crystal control signal 21 is the minimum second liquid crystal control signal.

As shown in FIG. 5A, by substituting the above values into Equation (1) and setting the gamma factor as 2, it is derived that, in the frame, the second backlight control signal 30 of the red light is 623; the second backlight control signal 30 of the green light is 383; and the second backlight control signal 30 of the blue light is 90. Similarly, in FIG. 5B, it is learned through calculation that the second backlight control signal 30 of the red light is 597; the second backlight control signal 30 of the green light is 309; and the second backlight control signal 30 of the blue light is 121.

Although part of the gray level values of the backlight brightness of the second backlight control signals 30 are greater than the maximum value, i.e. 255, of the 8-bit control signal, a known boosting technology may be employed to facilitate achieving the desired effects.

Generating a second liquid crystal control signal of each pixel S115: since the finally displayed chromatic frame and the chromatic frame generated by the input frame signal possess an identical light intensity, the second liquid crystal control signal 31 can be generated according to the known second backlight control signal 30, wherein the second liquid crystal control signal 31 of each pixel is derived from the following equation:

$$LC_{HDR}=(BL_{Full}/BL_{HDR})^{1/r}*LC_{Full,pixel} \quad (2)$$

Therein, $LC_{HDR}$ is the second liquid crystal control signal 31 of each pixel; $BL_{Full}$ is the first backlight control signal 10; $BL_{HDR}$ is the second backlight control signal 30; r is a gamma factor; and $LC_{Full,pixel}$ is the first liquid crystal control signal 11 of each pixel. Besides, in view of possible interference among the backlight sources of the frames, $BL_{Full}$ in the above equation (2) may be replaced by the light intensity of the first backlight control signal 10 while $BL_{HDR}$ may be replaced by the light intensity of the second backlight control signal 30, so as to derive the second liquid crystal control signal 31 of enhanced accuracy and appropriateness.

As shown in FIG. 5A, the first backlight control signal 10 is 255, and the second backlight control signal 30 is also derived as described above, while the gamma factor is 2. In addition, the first liquid crystal control signals 11 of the red light are 250, 248, 242, . . . , 160, 159, etc; the first liquid crystal control signals 11 of the green light are 195, 195, 195, . . . , 121, 122, etc; and the first liquid crystal control signals 11 of the blue light are 92, 91, 84, . . . , 82, 81, etc. Thus, by substituting these values into Equation (2), it is derived that the second liquid crystal control signals 31 of the red light are 160, 159, 155, . . . , 102, 102, etc; the second liquid crystal control signals 31 of the green light are 159, 159, 159, . . . , 99, 100, etc; and the second liquid crystal control signals 31 of the blue light are 155, 153, 141, . . . , 138, 136, etc.

As shown in FIG. 5B, the first backlight control signal 10 is 255, and the second backlight control signal 30 is also derived as described above, while the gamma factor is 2. In addition, the first liquid crystal control signals 11 of the red light are 250, 248, 242, . . . , 160, 159, etc; the first liquid crystal control signals 11 of the green light are 195, 195, 195, . . . , 121, 122, etc; and the first liquid crystal control signals 11 of the blue light are 92, 91, 84, . . . , 82, 81, etc. Thus, by substituting these values into Equation (2), it is derived that the second liquid crystal control signals 31 of the red light are 163, 162, 158, . . . , 105, 104, etc; the second liquid crystal control signals 31 of the green light are 177, 177, 177, . . . , 110, 111, etc; and the second liquid crystal control signals 31 of the blue light are 134, 132, 122, . . . , 119, 118, etc.

Hence, the method of generating frame control signals for reducing reaction time of the present embodiment may be applied to LCD devices based on various displaying technologies. By confining the second liquid crystal control signals 31 to the second liquid crystal control signal range 20 and simultaneously implementing the second backlight control signals 30 to display the frame, not only the liquid crystal reaction time is reduced, but also the intact frame quality can be presented. Also, the refresh frequency of the frame is enhanced so that the image blurs and CBU of FSC LCD devices can be reduced.

The method of generating frame control signals for reducing reaction time of the present embodiment may be applied to, for example, the FSC technology so as to compress the display time of each sub-frame and enhance refresh frequency of the frame by separately generating the red, green and blue sub-frames, resulting in reduced CBU.

Alternatively, the method of generating frame control signals for reducing reaction time of the present embodiment may be applied to the HDR technology to improve the frame definition. As shown in FIG. 2, by dividing the frame into a plurality of display regions; generating a first reference liquid crystal control signal 12 for each said display region; setting the second liquid crystal control signal range 20 to generate the second reference liquid crystal control signal 21; generating the second backlight control signal 30 of each said display region according to the first reference liquid crystal control signal 12 and the second reference liquid crystal control signal 21 of the display region, respectively, and generating the second liquid crystal control signal 31 of each pixel according to the second backlight control signal 30 of each said display region, the disclosed method helps to improve the frame definition.

Although the particular embodiments of the embodiment have been described in detail for purposes of illustration, it will be understood by one of ordinary skill in the art that numerous variations will be possible to the disclosed embodiments without going outside the scope of the embodiment as disclosed in the claims.

What is claimed is:

1. A method of generating frame control signals for reducing reaction time, comprising following steps:

analyzing an input frame signal of a frame to acquire a plurality of first liquid crystal control signals and a plurality of first backlight control signals of each of a plurality of color lights by writing the input frame signal into a signal control module of an LCD device;

generating a first reference liquid crystal control signal of the frame by analyzing all the first liquid crystal control signals of the frame;

setting a second liquid crystal control signal range and thereby generating a second reference liquid crystal control signal according to the second liquid crystal control signal range, wherein the second liquid crystal control signal range is a region of shorter reaction time for liquid crystals in the LCD device than a range of the first liquid crystal control signals;

generating a second backlight control signal that provides for brightness compensation of the frame according to the first reference liquid crystal control signal and the second reference liquid crystal control signal; and generating a second liquid crystal control signal of each pixel according to the second backlight control signal, wherein the second liquid crystal control signal of each said pixel is confined within the second liquid crystal control signal range;

thereby the frame is displayed as a chromatic frame according to the second liquid crystal control signals and the second backlight control signal such that the chromatic frame is displayed with a light intensity that matches with a light intensity of a chromatic frame that would be generated according to the input frame signal.

2. The method of claim 1, wherein the color lights comprises a red light, a green light and a blue light.

3. The method of claim 1, wherein the first reference liquid crystal control signal is the first liquid crystal control signal having a maximum value among the first liquid crystal control signals.

4. The method of claim 1, wherein the first reference liquid crystal control signal is the first liquid crystal control signal having a minimum value among the first liquid crystal control signals.

5. The method of claim 1, wherein the second reference liquid crystal control signal is the second liquid crystal control signal having a maximum value among the second liquid crystal control signals.

6. The method of claim 1, wherein the second reference liquid crystal control signal is the second liquid crystal control signal having a minimum value among the second liquid crystal control signals.

7. The method of claim 1, wherein the second backlight control signal is derived from a following equation:

$$BL_{HDR}=(LC_{REF1}/LC_{REF2})^{r}*BL_{Full}$$

wherein, $BL_{HDR}$ is the second backlight control signal; $LC_{REF1}$ is the first reference liquid crystal control signal; $LC_{REF2}$ is the second reference liquid crystal control signal; r is a gamma factor; and $BL_{Full}$ is the first backlight control signal.

8. The method of claim 1, wherein the second liquid crystal control signal of each said pixel is derived from a following equation:

$$LC_{HDR}=(BL_{Full}/BL_{HDR})^{1/r}*LC_{Full,pixel}$$

wherein, $LC_{HDR}$ is the second liquid crystal control signal of each pixel; $BL_{Full}$ is the first backlight control signal; $BL_{HDR}$ is the second backlight control signal; r is a gamma factor; and $LC_{Full,pixel}$ is the first liquid crystal control signal of each said pixel.

* * * * *